US005505166A

United States Patent [19]

Katoh

[11] Patent Number: 5,505,166

[45] Date of Patent: Apr. 9, 1996

[54] INDUCTION SYSTEM FOR ENGINE

[75] Inventor: Masahiko Katoh, Hamamatsu, Japan

[73] Assignee: Sanshin Kogyo Kabushiki Kaisha, Hamamatsu, Japan

[21] Appl. No.: 180,893

[22] Filed: Jan. 12, 1994

[30] Foreign Application Priority Data

Jan. 13, 1993 [JP] Japan ..... 5-019482

[51] Int. Cl.[6] ..... F02B 33/04

[52] U.S. Cl. ..... 123/41.31; 123/73 A

[58] Field of Search ..... 123/41.31, 468, 123/469, 540, 470, 73 A

[56] References Cited

U.S. PATENT DOCUMENTS

| | | | |
|---|---|---|---|
| 4,539,961 | 9/1985 | Atkins et al. | 123/469 |
| 4,722,708 | 2/1988 | Baltz | 123/468 |
| 4,735,177 | 4/1988 | Koike | 123/184.42 |
| 4,794,885 | 3/1989 | Honda et al. | 123/184.43 |
| 4,799,569 | 1/1989 | Hattori et al. | 180/219 |
| 4,932,368 | 6/1990 | Abe et al. | 123/559.1 |
| 4,967,704 | 11/1990 | Imaeda | 123/73 A |
| 5,003,933 | 4/1991 | Rush | 123/519 |
| 5,005,534 | 4/1991 | Washizu et al. | 123/184.43 |
| 5,007,386 | 4/1991 | Washizu et al. | 123/184.43 |
| 5,022,355 | 6/1991 | Billingsley et al. | 123/468 |
| 5,094,194 | 3/1992 | Russ, II et al. | 123/184.42 |
| 5,094,212 | 3/1992 | Kawaguchi et al. | 123/41.31 |
| 5,109,809 | 5/1992 | Fujimoto | 123/540 |
| 5,205,244 | 4/1993 | Nakamura et al. | 123/58.1 |
| 5,207,190 | 5/1993 | Torigai et al. | 123/73 A |
| 5,231,958 | 8/1993 | Takahashi et al. | 123/73 A |

FOREIGN PATENT DOCUMENTS

| | | |
|---|---|---|
| 0321313 | 12/1988 | European Pat. Off. . |
| 0352820 | 7/1989 | European Pat. Off. . |
| 879926 | 3/1943 | Germany . |
| 55-46045 | 3/1980 | Japan . |
| 58-96130 | 6/1983 | Japan . |
| 62-195452 | 8/1987 | Japan . |
| 63-100269 | 5/1988 | Japan . |
| 2-238163 | 9/1990 | Japan . |
| 2-241965 | 9/1990 | Japan . |
| 2-252918 | 10/1990 | Japan . |

OTHER PUBLICATIONS

European Search Report dated Apr. 6, 1992.

*Primary Examiner*—David A. Okonsky
*Attorney, Agent, or Firm*—Knobbe, Martens, Olson & Bear

[57] ABSTRACT

A number of embodiments of induction system for fuel injected outboard motors. In each embodiment the fuel injectors are bounded on at least two sides by the induction system so that the airflow through the induction system will cool the fuel injectors.

21 Claims, 5 Drawing Sheets

INDUCTION SYSTEM FOR ENGINE

BACKGROUND OF THE INVENTION

This invention relates to an induction system for an engine and more particularly to an improved induction system for a fuel-injected outboard motor.

In the interest of conserving fuel resources and protecting the atmosphere, it has been the practice to employ fuel injection systems for internal combustion engines. Fuel injection systems are utilized because they offer more accurate control over the fuel flow for a wide variety of running conditions. These systems are employed with many applications for internal combustion engines, including outboard motors.

Although fuel injectors offer good control of fuel economy and exhaust emission, there are some running conditions wherein the present induction systems can be improved. For example, with an outboard motor the engine is frequently operated for a long period of time at very low speeds. For example, when trolling the engine may actually be run for long periods of time at speeds that are even less than idle speed.

With most forms of fuel injection, it is the practice to control the amount of pressure of the fuel supplied to the fuel injector by utilizing a pressure relief valve which bypasses fuel back to the fuel system from the fuel injector. When operating at these low speeds such as they are encountered during trolling, more fuel is actually bypassed than is consumed. The continuous recirculation of the large quantity of fuel, particularly in proximity to the engine, can give rise to increase in the temperature of the fuel. This can cause vapor bubbles to form in the fuel and can upset the fuel air ratio. These problems are particularly acute due to the compact nature of outboard motors and the fact that the engine is normally surrounded rather closely by a surrounding protective cowling.

Also, it is normally the practice to employ an electrically operated fuel injector and this may include one or more solenoids that are electrically operated and which control the injection. The electrical solenoid adds further heat to the system which can further heat the fuel and cause the problems aforenoted.

It is, therefore, a principal object to this invention to provide an improved induction system for an engine.

It is a further object of this invention to provide an improved induction system for a fuel injected outboard motor.

It is yet a further object of this invention to provide an induction system for a fuel injected outboard motor wherein the induction system is constructed and arranged in such a way as to provide a cooling operation for the fuel injectors so as to avoid the problems as aforenoted.

SUMMARY OF THE INVENTION

This invention is adapted to be embodied in an outboard motor that is comprised of a power head having an internal combustion engine and a surrounding protection cowling. A drive shaft housing and lower unit depend from the power head and contain a propulsion device driven by the engine for propelling an associated watercraft. The engine has an induction system and a fuel injector for injecting fuel to the engine through the induction system. The fuel injector is bounded on at least two sides by the induction system so that the air flow through the induction system will cool the fuel injector and the fuel delivered thereby.

DETAILED DESCRIPTION OF THE PREFERRED EMBODIMENTS OF THE INVENTION

Figure 1:
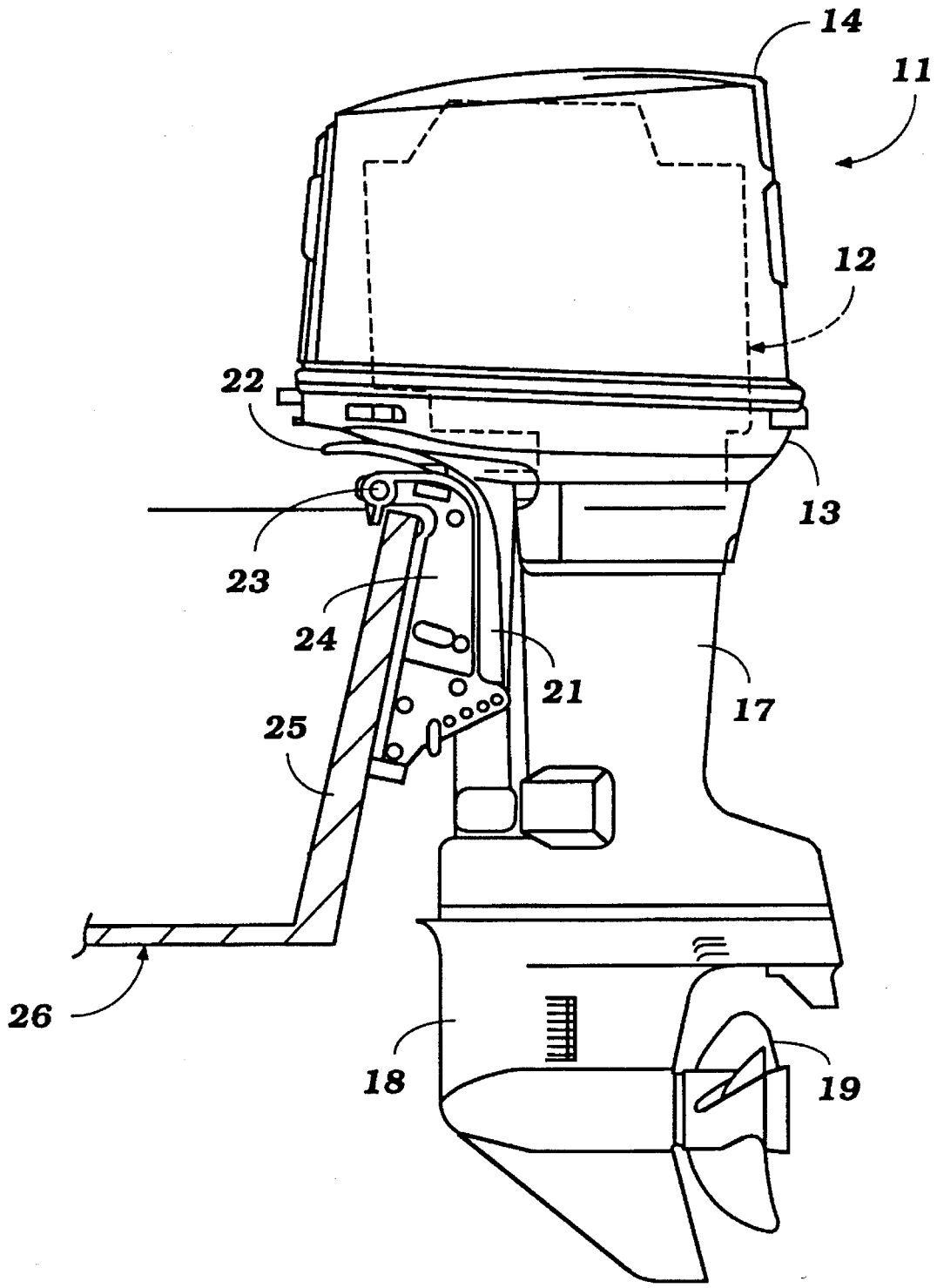
FIG. 1 is a side elevational view of an outboard motor constructed in accordance with an embodiment of the invention, as attached to the transom of an associated water craft, shown partially and in cross section.
Figure 2:
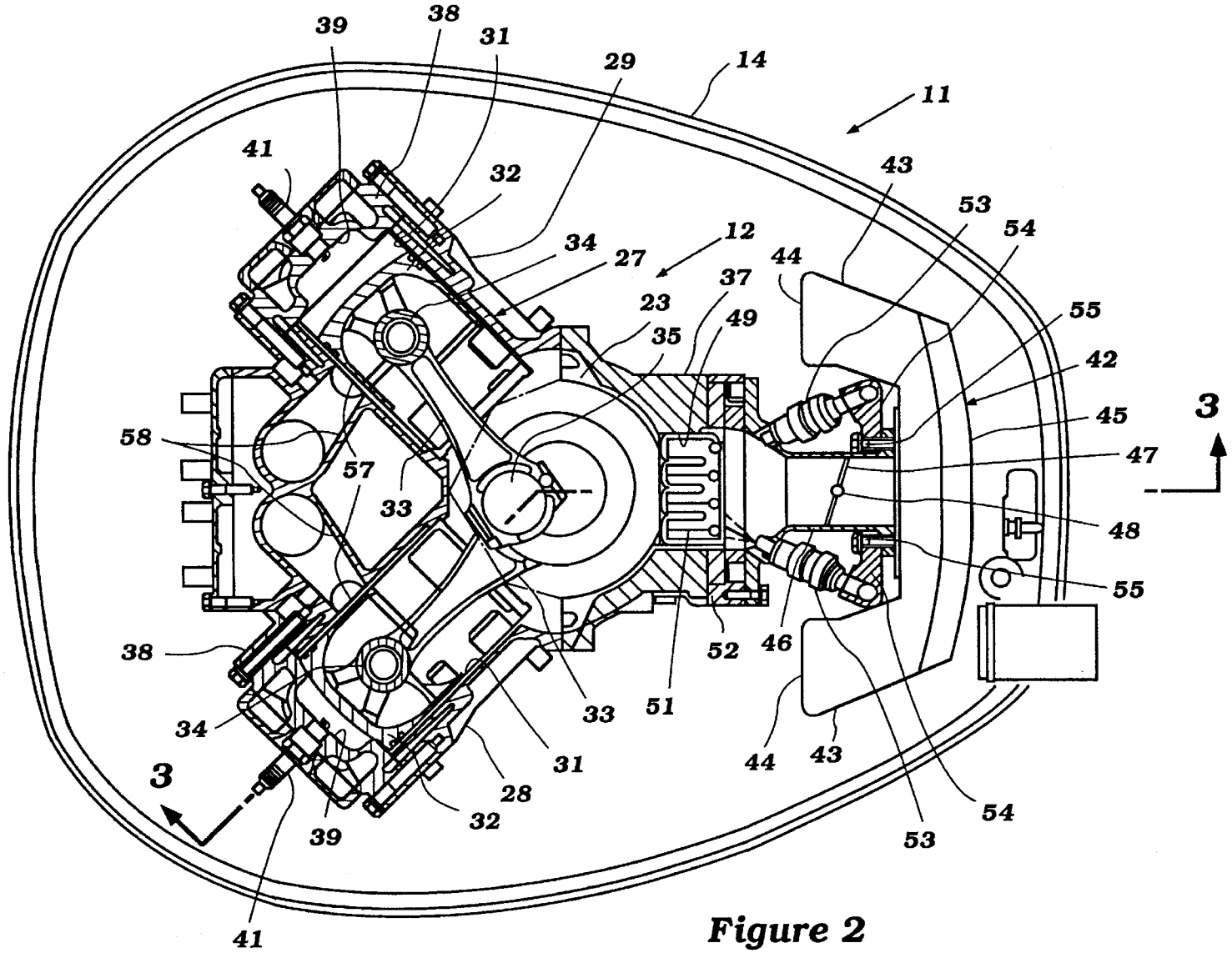
FIG. 2 is an enlarged top plan view of the power head of the outboard motor, with portions broken away and shown in section.
Figure 3:
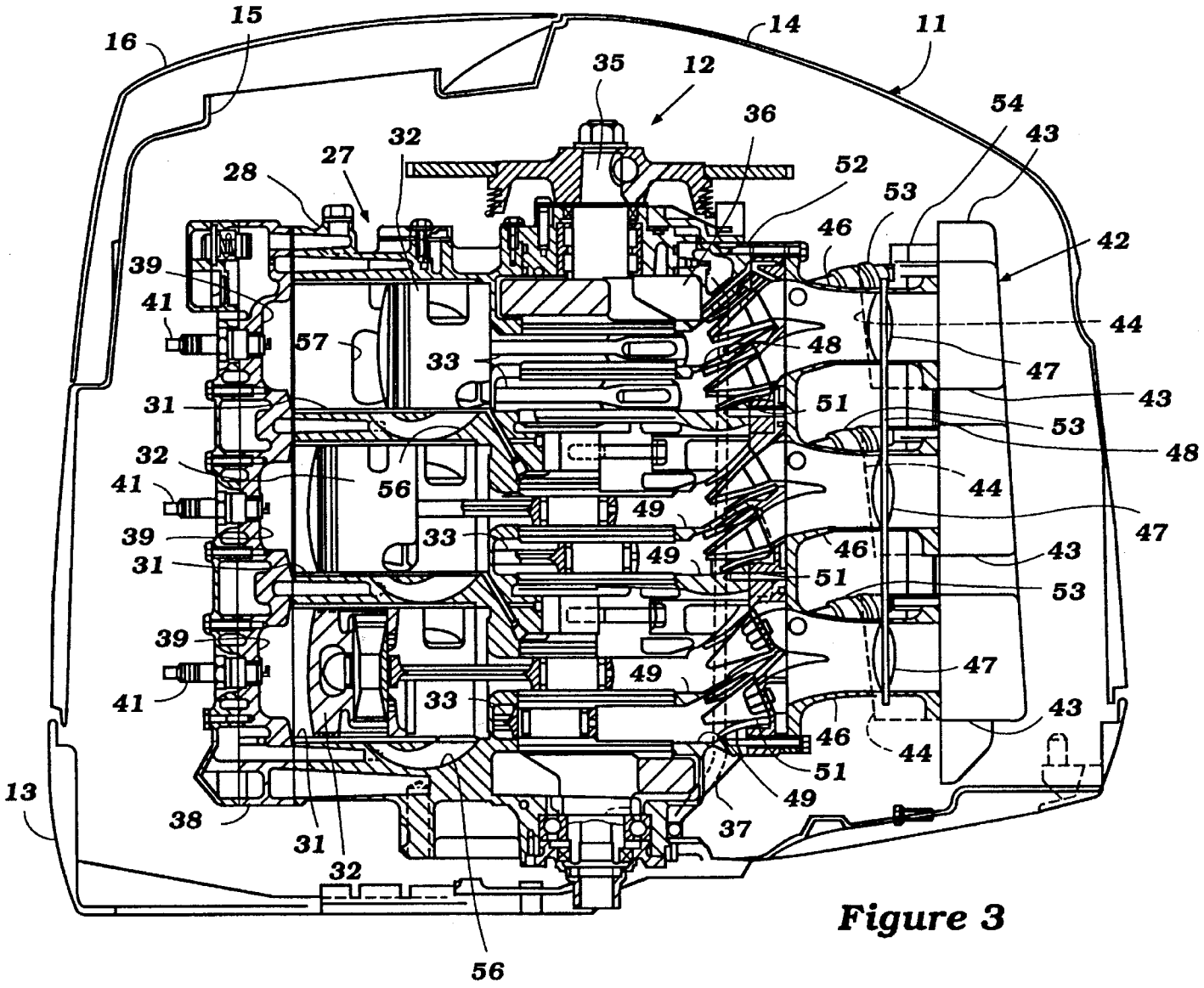
FIG. 3 is a cross-sectional view taken along the line 3—3 of FIG. 2.

Referring now in detail to the drawings and the embodiment of FIGS. 1 through 3, initially concentrating on FIG. 1, an outboard motor constructed in accordance with this embodiment of the invention is identified generally by the reference numeral 11. The outboard motor 11 is comprised of a power head that consists of an internal combustion engine, indicated generally by the reference numeral 12 and shown in most detail in FIGS. 2 and 3 and a surrounding protective cowling that is comprised of a lower tray portion 13 and an upper main cowling portion 14. The tray portion 13 and main cowling portion 14 may be formed from any suitable materials and these components are detachably connected to each other.

The main cowling portion 14 is defined with an air inlet that is comprised of an generally upwardly extending air inlet opening 15 covered by a cowling portion 16 to define an opening so that atmospheric air may be drawn into the interior of the protective cowling through the opening 15 while reducing, as much as possible, the induction of water into the interior of the protective cowling.

As will become more apparent as the engine 12 is described by more reference to FIGS. 2 and 3, it is supported with its output shaft rotating about a vertically extending axis and this output shaft is coupled to a drive shaft (not shown) that depends into and is journalled within a drive shaft housing 17. The drive shaft housing 17 depends from the power head as thus far described and is directly connected to the lower tray 13 in a well-known manner. A lower unit 18 is provided at the lower end of the drive shaft housing 17 and this contains a conventional forward, neutral, reverse transmission (not shown) for driving a propeller 19 or other form of propulsion device in selected forward and reverse directions.

A steering shaft (not shown) is affixed to the drive shaft housing 17 and is supported for steering movement about a generally vertically extending steering axis within a swivel bracket 21. A tiller 22 is affixed to the upper end of this steering shaft for steering of the outboard motor 11 in a well-known manner.

The swivel bracket 21 is pivotally connected by means of a horizontally extending pivot pin 23 to a clamping bracket 24 for tilt and trim movement of the outboard motor 11 as is also well known in this art. The clamping bracket 24 includes a suitable clamping mechanism (not shown) so as to affix the outboard motor 11 to a transom 25 of an associated watercraft, shown partially and indicated generally by the reference numeral 26.

The construction of the outboard motor 11 is thus far described may be considered to be conventional and, for that reason, detailed description of the remaining components are not believed to be necessary to permit those in the art to practice the invention. Also, it is to be understood that the description in conjunction with an outboard motor is just typical of the environment in which the invention may be practiced. However, the invention does have particular utility in conjunction with outboard motors because of their compact nature and also the fact that the powering internal combustion engine 11 may be operated for long periods of time at very low speeds, in fact speeds lower than idle speed such as when trolling.

The invention deals primarily with the induction system and fuel injection system for the engine 11 and that system will now be described in more detail by particular reference to FIGS. 2 and 3. The engine 12 is comprised of a cylinder block, indicated generally by the reference numeral 27 that may be configured so as to contain any number of cylinders disposed in any form of relationship. In the illustrated embodiment, the engine 12 is of the V-6 type and as such the cylinder block 27 is provided with a pair of angularly-related cylinder banks 28 and 29 each of which is formed with three vertically-spaced cylinder bores 31 formed by cylinder liners that may be pressed or cast in place in the cylinder block 27. This assumes that the cylinder block 27 is formed from a light alloy such as aluminum or the like and the cylinder bores 31 are formed by liners. Obviously, other forms of constructions may be employed, as is well known in the art.

Pistons 32 are slidably supported in each of the cylinder bores 31 and are connected to the small or upper ends of connecting rods 33 by piston pins 34 in a well-known manner. The lower ends of the connecting rods 33 are journalled on adjacent throws of a crankshaft, indicated generally by the reference numeral 35 and which, as been aforenoted, rotates about a vertically extending axis. Although the invention is described in conjunction with paired connecting rods, it will be obvious to those skilled in the art that other forms of arrangements may be employed, as are well known in the art.

The crankshaft 35 is rotatably journalled within a crankcase chamber 36 formed by the skirt of the cylinder block 27 and a crankcase member 37 that is affixed in any suitable manner to the cylinder block 27. In the illustrated embodiments, the engine 12 is of the twocycle crankcase compression type and as is typical with this type of engine, the crankcase chambers 36 associated with each of the cylinder bores 31 are sealed from each other in any suitable manner.

A pair of cylinder head assemblies 38 are each affixed to a respective one of the cylinder banks 28 and 29 of the cylinder block assembly 27 in a well-known manner. Each cylinder head 38 is provided with cavities 39 in their lower faces which cooperate with the cylinder bores 31 and pistons 32 to form the combustion chambers of the engine. Spark plugs 41 are mounted in the cylinder head assemblies 38 and have their gap extending into the recesses 39 for firing a charge therein in any well-known manner. It should be noted that the cylinder head assemblies 38 are disposed so that they extend toward the rear of the outboard motor while the crankcase chambers 36, extend toward the front of the outboard motor.

An induction system is provided at the forward of the outboard motor 11 for supplying an air and fuel charge to the individual crankcase chambers 36 associated with each of the cylinder bores 31. This induction system includes an air inlet device, indicated generally by the reference numeral 42 and which is positioned at the forward end of the main cowling member 14. This air inlet device 42 is formed with rearwardly extending sections 43 that have rearwardly facing air inlet openings 44 through which the air which is admitted through the protective cowling opening 15 may be drawn and flow forwardly toward the front of the protective cowling main member 14 and enter a plenum chamber 45 that extends transversely between the inlet portions 43. As may be best seen in FIG. 3, there is provided a separate inlet portion 43 at each side of the engine and each having it own respective opening 44 for each cylinder of the engine.

The plenum chamber portion 45 has three outlet openings that communicate with respective vertically disposed throttle bodies 46 each of which has a common inlet opening that communicates with the air inlet device outlet openings as aforenoted. Throttle valves 47 are mounted in these common portions upon a single throttle valve shaft 48 that links the throttle valves 47 for each pair of cylinders with each other. A suitable remotely position throttle control (not shown) is coupled to the throttle valve shaft 48 for rotating the throttle valves 47 between their closed or idle positions and their wide opened throttle positions, as is well known in this art. Although the invention is described in conjunction with an arrangement wherein each throttle body 46 has a common inlet opening in which a throttle valve 47 is positioned for pairs of cylinders, it should be understood that an individual throttle body may be employed for each cylinder. However, the described construction permits a simpler arrangement.

Each throttle body 46 has a pair of discharges which cooperate with respective intake ports 49 formed in the crankcase number 37 and which communicate with the respective crankcase chambers 36 associated with each cylinder bore 31. As is conventional with two-cycle crankcase compression engines, a reed-type valve assembly 51 has a base portion 52 that is affixed to the crankcase member 37 beneath the throttle bodies 46 and which permits flow from the throttle bodies into the respective crankcase chambers 36 as the pistons 32 move upwardly in the cylinder bores 31. These reed-type valve assemblies 51, however, will close when the charge is being compressed in the crankcase chambers so as to preclude reverse flow.

A pair of fuel injectors 53 are mounted in each throttle body 46 and disposed so as to spray into the respective outlet passages thereof downstream of the throttle valves 47. As may be readily apparent from FIG. 2, each fuel injector 53 is substantially surrounded by the induction system and is bounded on its opposites by the throttle body 46 and the air inlet portions 43 of the air inlet device 42. The upper or tip portions of the fuel injectors 53 are enclosed by the plenum chambers section 45 of the air inlet device 42 so that the fuel injectors 53 are substantially encircled by the induction system. Hence, air flowing into the engine through the induction system will surround the fuel injectors 53 and will convey any heat away from them so as to avoid over heating of the fuel, even when the engine is running at low speeds such as trolling speeds and a large amount of fuel is being bypassed back to the fuel supply system.

Fuel rails 54 are affixed to the fuel injectors 53 at each side of the throttle bodies 46 and are in fact mounted by bolts 55 to the air inlet device 42 and specifically the plenum chamber portion 45 so as to convey heat from the fuel rails 54. The fuel rails 54 include one or more pressure regulators (not shown) that control the pressure of the fuel as supplied to the fuel injectors 53 by bypassing fuel back to the fuel supply system in a well-known manner.

The fuel air charge thus formed which is drawn into the crankcase chambers 36 through the respective intake ports 49 and is compressed on downward movement of the pistons 32. This charge is then transferred to the combustion chambers through one or more scavenge passages 56 formed in the cylinder block 27 so as to provide any desired scavenging flow. This charge is further compressed as the pistons 32 move upwardly and then fire by the spark plugs in a well-known manner.

The charge then burns and expands to drive the pistons 32 downwardly. Eventually, exhaust ports 57 formed in the cylinder block 27 in the valley between cylinder banks 28 and 29 will be opened and the exhaust gases can flow into an exhaust manifold 58 formed in the cylinder block 27 in this valley. These exhaust gases are then discharged downwardly through an exhaust system of a known type contained within the drive shaft housing 17 and lower unit 18.

Figure 4:
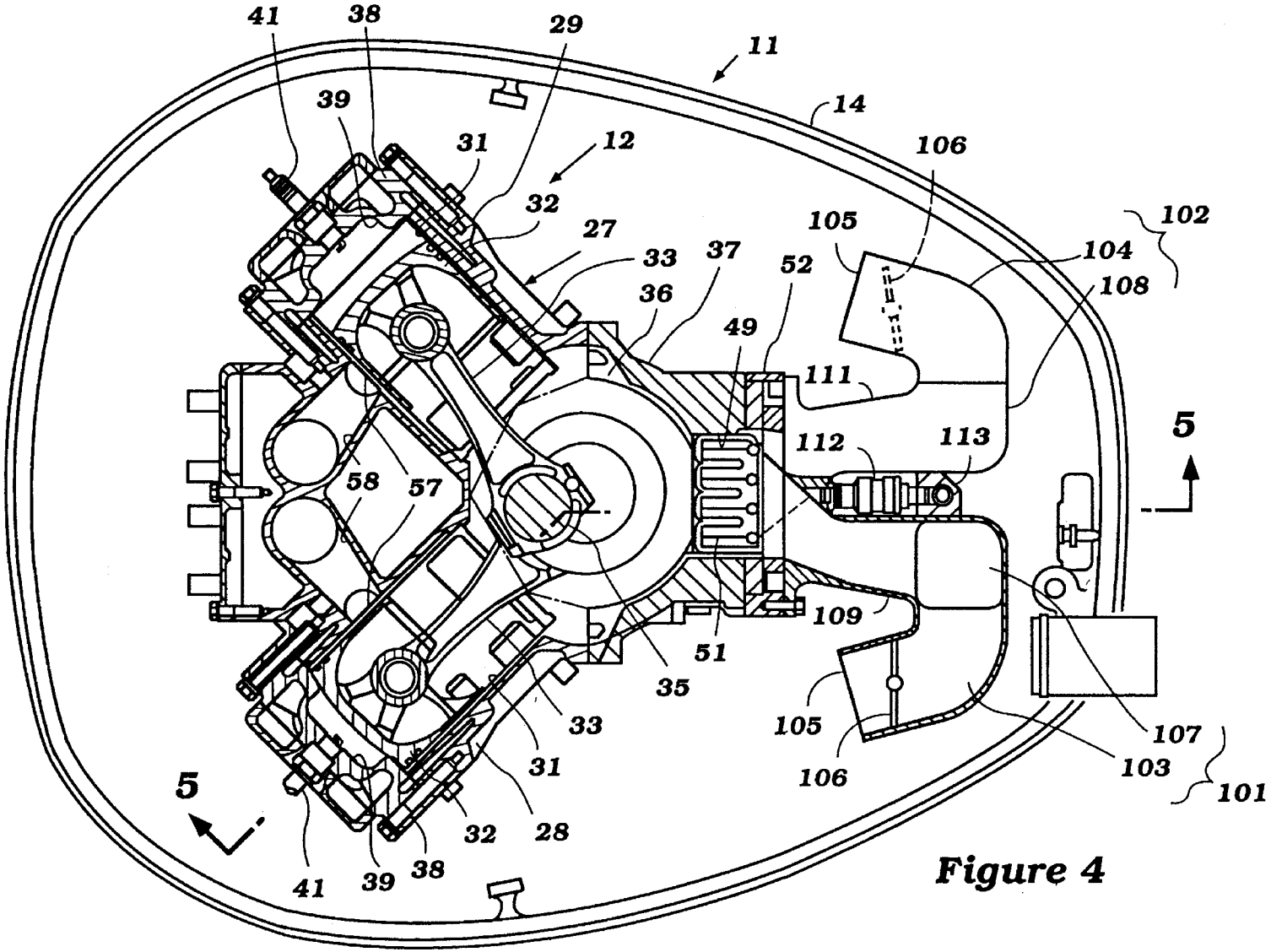
FIG. 4 is a top plan view, with portions shown in section, in part similar to FIG. 2 and shows another embodiment of the invention.
Figure 5:
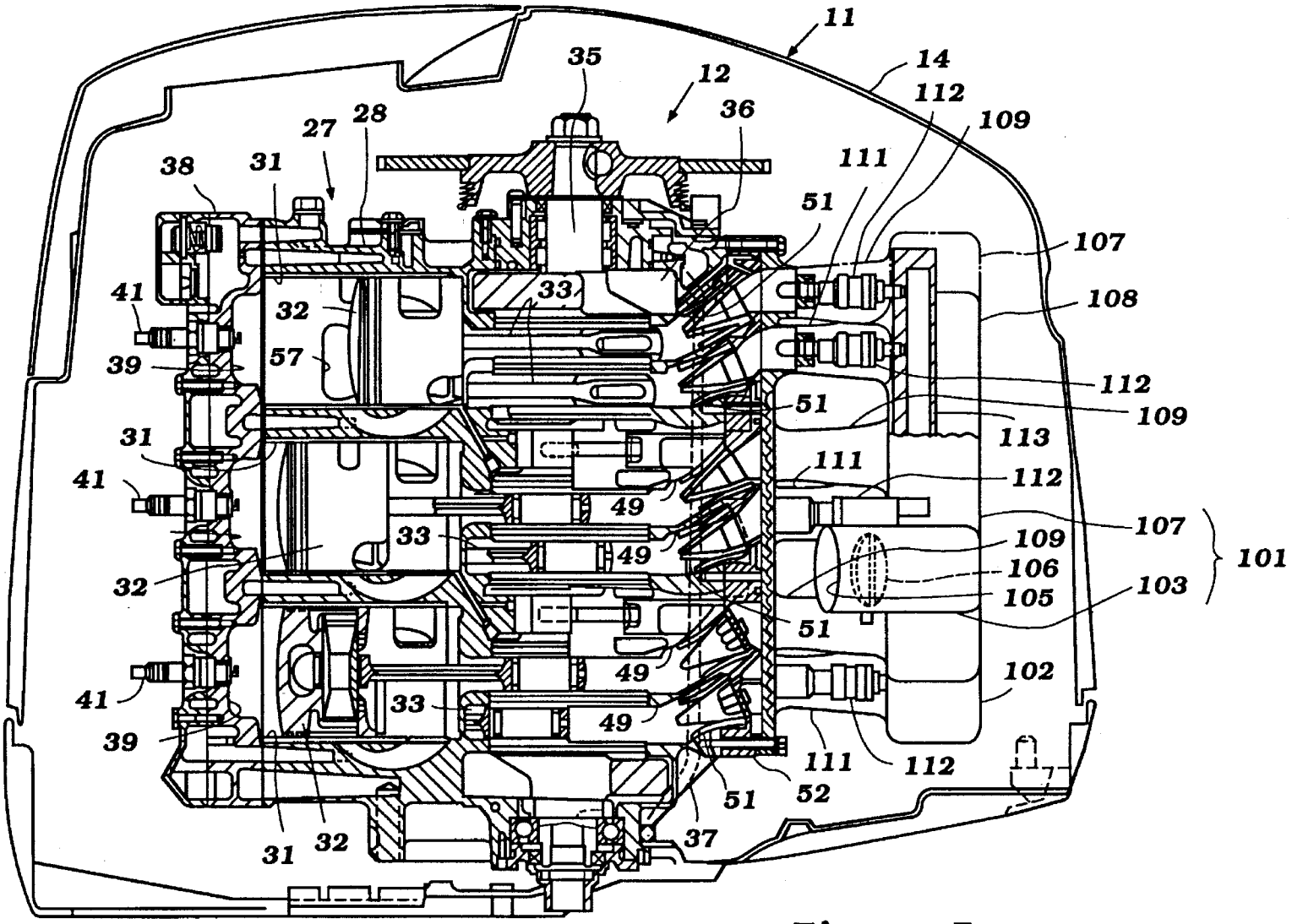
FIG. 5 is a cross-sectional view, in parts similar to FIG. 3 but is taken along the line 5—5 of FIG. 4.

FIGS. 4 and 5 show another embodiment of the invention which is generally the same as the embodiment of thus far described. The only difference between this embodiment and that already described is in the configuration of the induction system and the positioning of the fuel injectors. For that reason, components of the engine which are the same as the previously described embodiment have been identified by the same reference numerals and will be described again and only insofar as is necessary to understand the construction and operation of this embodiment.

In this embodiment, the engine 12 is provided with a pair of air inlet devices, indicated by the reference numerals 101 and 102, respectively. These inlet devices comprise inlet portions 103 and 104, respectively, having rearwardly facing air inlet openings 105 in which throttle valves 106 are positioned. The throttle valves 106 for each of the air inlet devices 101 and 102 are connected to each other so that they will all be operated simultaneously. There is provided one throttle valve 106 for each cylinder of the engine with the air inlet device 101 serving the cylinder bank 29 and the air inlet device 102 serving the cylinder bank 28.

The inlet sections 103 and 104 are connected to plenum chamber sections 107 and 108, respectively, which then feed respective runners 109 and 111 that extend to the intake ports 49 of the crankcase member 37. These intake ports 49 have read valves 51 formed in them for the reason already noted. It should be noted that the runners 109 and 111 define an area between them and fuel injectors 112 are provided in this area between the individual runners 109 and 111 and are supplied with fuel from a common fuel rail 113 which has provided in it a pressure relief valve for maintaining a uniform pressure of fuel supplied to each of the fuel injectors 112 as would the previously described embodiment.

It should be readily apparent that the fuel injectors 112 are substantially surrounded by the induction system except in this embodiment the tops or tips of the fuel injectors 112 are not surrounded. However, the fuel rail 113 is in direct contact with both of the air inlet devices 101 and 102 and hence will be well cooled.

From the foregoing description it should be readily apparent that the described embodiments of the invention provide a very efficient induction system for an engine wherein the fuel injectors are substantially surrounded by the induction system and hence will be well cooled by the air flowing to the engine through the induction system. 0f course, the foregoing description is that of preferred embodiments of the invention and various changes and modifications may be made without departing from the spirit and scope of the invention, as defined by the appended claims.

I claim:

1. An outboard motor comprised of a power head having an internal combustion engine and a surrounding protective cowling, a drive shaft housing and lower unit depending from said power head and containing a propulsion device driven by said engine for propelling an associated watercraft, said engine having an induction system and a fuel injector for delivering fuel to said engine through said induction system, said fuel injector being bounded on at least two sides by said induction system.

2. The outboard motor of claim 1 wherein the engine is provided with a plurality of fuel injectors all bounded on at least two sides by the induction system.

3. The outboard motor of claim 1 wherein the portion of the induction system bounding the fuel injector experiences flow for providing a cooling air flow around the a fuel injector for its cooling.

4. The outboard motor of claim 3 wherein the induction system has a first portion extending on one side of the fuel injector, a second portion extending on the other side of the fuel injector and a third portion interconnecting the first and second portions and extending across the tip of the fuel injector.

5. The outboard motor of claim 4 further including a fuel rail affixed to the tip of the fuel injector for supplying fuel thereto, said fuel rail being in heat exchanging relationship with the third portion of the induction system.

6. The outboard motor of claim 5 wherein the engine is provided with a plurality of fuel injectors all bounded on at least two sides by the induction system.

7. The outboard motor of claim 3 when the flow of air through the induction system is along the first portion and back in an opposite direction along the second portion.

8. The outboard motor of claim 3 wherein the flow through the induction portion systems sections is in the same direction.

9. The outboard motor of claim 1 wherein the engine has a pair of cylinder banks diverging from a common crankcase chamber and each having a plurality of cylinder bores, the engine operating on a two-cycle crankcase compression principal and the induction system supplying the charge to the crankcase chamber of the engine.

10. The outboard motor of claim 9 wherein the engine is provided with a plurality of fuel injectors for each cylinder all bounded on at least two sides by the induction system.

11. The outboard motor of claim 9 wherein the portion of the induction system bounding the fuel injector experiences flow for providing a cooling air flow around the a fuel injector for its cooling.

12. The outboard motor of claim 11 wherein the induction system has a first portion extending on one side of the fuel injector, a second portion extending on the other side of the fuel injector and a third portion interconnecting the first and second portions and extending across the tip of the fuel injector.

13. The outboard motor of claim 12 further including a fuel rail affixed to the tip of the fuel injector for supplying fuel thereto, said fuel rail being in heat exchanging relationship with the third portion of the induction system.

14. The outboard motor of claim 13 wherein each bank of the engine is provided with a plurality of fuel injectors all bounded on at least two sides by the induction system.

15. The outboard motor of claim 11 when the flow of air through the induction system is along the first portion and back in an opposite direction along the second portion.

16. The outboard motor of claim 11 wherein the flow through the induction portion systems sections is in the same direction.

17. The outboard motor of claim 9, wherein the induction system is provided with a plurality of discharge portions, all disposed generally in a common vertically extending plane.

18. The outboard motor of claim 17, wherein the fuel injectors are provided in pairs, with the injectors of the pairs being disposed on opposite sides of the respective discharge portions of the induction system.

19. The outboard motor of claim 18, wherein one fuel injector of each pair serves one cylinder bank, and the other fuel injector of each pair serves the other cylinder bank.

20. The outboard motor of claim 18, further including a throttle valve arrangement containing a plurality of butterfly-type throttle valves, one for each induction passage, and all fixed to a common throttle valve shaft lying in the vertical plane.

21. The outboard motor of claim 17, wherein the fuel injectors all lie in a common vertical plane, and the induction system is comprised of a pair of branches, each extending from the discharge portion along a respective side of said fuel injectors.

* * * * *